US010563630B2

(12) United States Patent
Berkemeier et al.

(10) Patent No.: US 10,563,630 B2
(45) Date of Patent: Feb. 18, 2020

(54) INJECTION VALVE FOR AN INTERNAL COMBUSTION ENGINE

(71) Applicant: Ford Global Technologies, LLC, Dearborn, MI (US)

(72) Inventors: Oliver Berkemeier, Bergisch Gladbach (DE); Stefan Quiring, Leverkusen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 595 days.

(21) Appl. No.: 15/062,515

(22) Filed: Mar. 7, 2016

(65) Prior Publication Data

US 2016/0290296 A1 Oct. 6, 2016

(30) Foreign Application Priority Data

Mar. 30, 2015 (DE) ..... 10 2015 205 668

(51) Int. Cl.

| | |
|---|---|
| ***F02M 53/04*** | (2006.01) |
| ***F02M 37/22*** | (2019.01) |
| ***F02M 51/00*** | (2006.01) |
| *F02M 43/00* | (2006.01) |

(52) U.S. Cl.

CPC ..... *F02M 53/043* (2013.01); *F02M 37/22* (2013.01); *F02M 51/00* (2013.01); *F02M 53/04* (2013.01); *F02M 43/00* (2013.01); *F02M 2700/077* (2013.01)

(58) Field of Classification Search

CPC ..... F02M 53/043; F02M 37/22; F02M 51/00; F02M 53/04; F02M 43/00; F02M 2700/077; F02M 53/08; F02M 2700/4359; F23R 3/283; F23R 2900/03041; F23R 2900/03042; B05B 9/002; B05B 7/16

USPC ..... 239/5, 13, 132–132.5, 139

See application file for complete search history.

(56) References Cited

U.S. PATENT DOCUMENTS

| | | | | |
|---|---|---|---|---|
| 2,750,957 A * | 6/1956 | Tavola | F02M 61/10 | 137/510 |
| 2,887,994 A * | 5/1959 | Morris | F01P 1/10 | 123/276 |
| 4,823,756 A * | 4/1989 | Ziejewski | F02M 51/00 | 123/1 A |

(Continued)

FOREIGN PATENT DOCUMENTS

| | | |
|---|---|---|
| DE | 2130174 A1 | 12/1972 |
| DE | 112004000701 T5 | 4/2006 |

(Continued)

OTHER PUBLICATIONS

State Intellectual Property Office of the People's Republic of China, Office Action and Search Report Issued in Application No. 201610181229.9, dated May 8, 2019, 12 pages. (Submitted with Partial Translation).

*Primary Examiner* — Cody J Lieuwen

(74) *Attorney, Agent, or Firm* — Greg Brown; McCoy Russell LLP

(57) ABSTRACT

The disclosure relates to an injection valve for an internal combustion engine of a motor vehicle, having a cooling device for cooling the injection valve. The mentioned cooling device is a thermosiphon cooling device, wherein the thermosiphon cooling device comprises a reservoir volume, and wherein the cooling element has a thermally conductive connection to the reservoir volume.

5 Claims, 3 Drawing Sheets

(56) References Cited

U.S. PATENT DOCUMENTS

| | | | | |
|---|---|---|---|---|
| 5,797,378 | A * | 8/1998 | Kato | F02B 61/045 123/198 E |
| 6,718,954 | B2 | 4/2004 | Ryon | |
| 7,021,558 | B2 | 4/2006 | Chenanda et al. | |
| 8,056,537 | B2 | 11/2011 | Venkataraghavan et al. | |
| 8,078,386 | B2 | 12/2011 | Stein et al. | |
| 2007/0044767 | A1* | 3/2007 | Kojima | F02M 53/043 123/470 |
| 2008/0196700 | A1* | 8/2008 | Chyo | F02M 31/20 123/541 |
| 2009/0302130 | A1* | 12/2009 | Venkataraghavan | F02M 53/04 239/132 |
| 2010/0084489 | A1 | 4/2010 | Chang | |
| 2011/0042476 | A1* | 2/2011 | McAlister | F02M 57/005 239/5 |
| 2014/0116393 | A1 | 5/2014 | Fiveland et al. | |
| 2015/0211410 | A1* | 7/2015 | Saville | F01P 3/16 123/41.52 |
| 2016/0047343 | A1* | 2/2016 | Imoehl | F02M 51/061 239/397.5 |

FOREIGN PATENT DOCUMENTS

| | | | |
|---|---|---|---|
| DE | 102013006420 | B4 | 11/2014 |
| GB | 2190426 | A | 11/1987 |
| GB | 2404949 | A | 2/2005 |

* cited by examiner

INJECTION VALVE FOR AN INTERNAL COMBUSTION ENGINE

CROSS REFERENCE TO RELATED APPLICATION

The present application claims priority to German Patent Application No. 102015205668.6, filed on Mar. 30, 2015, the entire contents of which are hereby incorporated by reference for all purposes.

FIELD

The present description relates generally to system and methods for an injection valve for an internal combustion engine of a motor vehicle, having a cooling device for cooling the injection valve.

BACKGROUND/SUMMARY

An injection valve (injection nozzle) is a valve, which on an internal combustion engine, such as a spark-ignition or a diesel engine, injects fuel into the intake tract via port fuel injection (PFI) or into the combustion chamber via direct fuel injection (DI) of the internal combustion engine in order to drive the motor vehicle. In direct fuel injection the injection valve injects fuel directly into the combustion chamber of the internal combustion engine, whereas in port fuel injection, mixture formation takes place not in the combustion chamber, but upstream of the injection valve, for example downstream of a throttle valve.

US 2014/0116393 A1 discloses a system having an injection valve for injecting fuel into a cylinder of an internal combustion engine. A main cooling line is provided, through which coolant can circulate through the internal combustion engine. An auxiliary cooling line is also provided, which connects the main cooling line and carries coolant to the injection valve.

U.S. Pat. No. 8,078,386 B2 discloses a method for controlling the fuel supply to an internal combustion engine, which can be operated by means of port fuel injection and direct fuel injection. A second type of fuel is fed from a second tank to a direct fuel injection valve and a first type of fuel from a first tank to the port fuel injection device. In response to an unsuitable fuel, the first type of fuel from the first tank is fed to the direct fuel injection valve. In response to the receipt of an incorrect supply signal, the direct fuel injection can be supplied with the second type of fuel. By supplying at least some fuel of the other type to the direct fuel injection valve, it is possible, under various conditions, to use fuel to cool the direct fuel injection valve.

U.S. Pat. No. 6,718,954 B2 discloses a device for cooling fuel by means of a cold side of a thermoelectric unit before the fuel enters fuel delivery components, such as injectors, carburetors and throttle valves, for example. An excess of cooling energy is sufficient to cool the fuel delivery components, so as to supply a cooling buffer and prevent a reabsorption of heat once the fuel has been cooled. The warm side of the thermoelectric unit is cooled by a second cooling liquid system distinct and separated from the main cooling fluid system for the engine block. Excess fuel is led through a fuel bypass pressure regulator to a fuel bypass line, and the excess fuel becomes cooling liquid, which is returned to a fuel tank.

US 2008/0196700 A1 discloses a fuel cooling system for a diesel engine having a row of cylinders, a fuel tank, and a common-rail fuel injection system. The system comprises a fuel distributor circuit for delivering fuel from the fuel tank to the cylinders, a fuel recycling circuit recycling uninjected fuel, a temperature sensor for registering the fuel temperature, a fuel coolant heat exchange system for cooling the fuel, a coolant reservoir, an electrical coolant pump, and a heat exchange distributor also being provided. In addition, a mechanism is provided for controlling the electrical coolant pump operation, together with an air coolant heat exchange system, which is coupled to the fuel coolant heat exchanger system for cooling the fuel. In order to cool the coolant, the air coolant heat exchange system is exposed to vehicle ram air. In addition, a heat exchange distributor and a fan are provided, together with a mechanism for controlling the fan.

US 2010/0084489 A1 discloses a control arrangement for a fuel injection device. A leakage path ducts leakage fuel originating from an inlet to a fuel drain connection. The control arrangement comprises an individual tank, which supplies the inlet, and comprises a coolant connection to a plurality of injection valves, and collects fuel from the fuel drain connection of the plurality of injection valves.

U.S. Pat. No. 8,056,537 B2 discloses an internal combustion engine, such as a diesel engine with direct fuel injection. The injection valve according to U.S. Pat. No. 8,056,537 B2 comprises a first and a second inlet together with an actuator assembly for valve actuation. A cooling system for cooling the actuator assembly, which is coupled to a fuel system, is furthermore provided. The cooling system is designed to carry cooling liquid via a heat exchange surface of the actuator assembly, in order to exchange heat energy.

DE 11 2004 000 701 T5 (U.S. Pat. No. 7,021,558 B2) discloses an injection valve for injecting pressurized fuel into a combustion chamber of an internal combustion engine. A nozzle valve element has a longitudinal passage, which has an outer end for draining off a cooling liquid flow and an inner end for receiving a cooling liquid flow. The nozzle valve element furthermore has a transverse passage, which is situated next to the inner end of the longitudinal passage and extends transversely between the longitudinal passage and the nozzle bore. In operation, a quantity of coolant flows into the nozzle bore, through the transverse passage into the longitudinal passage and along the longitudinal passage in order to cool the nozzle valve element.

Dual-fuel vehicles are also known, in which two different fuels are fed to the internal combustion engine, the internal combustion engine being operated for a while with the one fuel and for a while with the other fuel. This may be, on the one hand, conventional gasoline or diesel fuel. On the other hand, this may be a gaseous fuel. The vehicle can thus be operated with the conventional fuel if the gas tank is empty and it is not possible to reach a refueling station. The range of the vehicle is thus extended compared to vehicles powered by gaseous fuels alone. The conventional fuel is conveniently injected directly into the combustion chamber, whilst the gaseous fuel is introduced into the intake tract. In this respect in a motor vehicle of flexible-fuel or also dual-fuel design or in a motor vehicle having an internal combustion engine which is operated both with port fuel injection and with direct fuel injection to the internal combustion engine, a flow of conventional fuel through the injection valve does not always ensue, so that there is no flowing fuel to exert a cooling effect on the injection valve. Since the injection valve for direct injection of the conventional fuel is inoperative due to operation of the internal combustion engine on the gaseous fuel (that is to say CNG, LNG, methanol, ethanol, natural gas, for example), there is therefore no fuel flow passing through it. If the injection valve is not cooled, the temperature not only at its tip but also on the seals may exceed a limit, with the resulting in operational malfunctions. Moreover, there may still be fuel present in the injection valve which is exposed to the considerable thermal load. Thus the retained fuel may warm up and under the effects of heat may crack and/or vaporize, that is to say evaporate, which naturally depends on the prevailing pressure ratios and temperature conditions.

The inventors herein have recognized the above issues and identified an approach by which the issues described above may be at least partly addressed. The object of the disclosure is to provide an injection valve for an internal combustion engine of a motor vehicle which comprises a cooling device affording an improved cooling effect.

In one example, the above issues may be at least partly addressed by a an injection valve for an internal combustion engine of a motor vehicle comprising: a cooling device for cooling the injection valve, wherein the cooling device is a thermosiphon cooling device comprising a reservoir volume, and a cooling element of the cooling device having a thermally conductive connection to the reservoir volume. The injection valve used for injecting conventional fuel directly into the combustion chamber comprises the thermosiphon cooling device.

The thermosiphon cooling device is a closed cooling system without the requirement of a pump. A circulation of the cooling medium, in this case fuel, that is to say liquid fuel such as diesel fuel or gasoline, is produced solely under the effect of gravity. The lower specific density of the warmer medium makes it lighter than the colder medium, so that the warmer medium rises to the top and the colder medium sinks to the bottom. Since the internal combustion engine is being operated in the gas mode, the cooling medium, that is to say the gasoline or diesel fuel, in the inoperative injection valve is warmed and therefore becomes lighter. It therefore rises to the top of the injection valve. There the cooling medium is cooled and therefore becomes heavier. It sinks down towards the tip of the injection valve and the whole process is repeated. The advantage of the thermosiphon cooling device is the simple construction without a pump. Furthermore, a gravitational circulation of the cooling medium can ensue even without any admission of the coolant (without any admission of fuel), and bring about cooling. It is therefore possible to cool even an inoperative injection valve, that is to say one not in operation and therefore without a flow of cooling fuel passing through it.

According to the disclosure, the thermosiphon cooling device comprises a reservoir volume. A first line inside the injection valve is connected to a fuel supply. The warmed fuel can rise in the reservoir volume, whilst at the same time the cooled fuel is able to sink again. It is practical here if the cross section of the reservoir volume, which may also be referred to as a ring line, is adapted so as to allow a simultaneous rise and fall.

The first line and the reservoir volume are arranged concentrically with one another. This arrangement affords a particularly good thermal coupling, especially of the reservoir volume in the compact design form of the injection valve. This again improves the cooling effect of the cooling device. The reservoir volume has a medium-carrying connection to the first line. It is advantageous if the first line is connected to the reservoir volume in the area of the tip of the injection valve. Also, an additional fuel line may be included to enhance flow of fuel (due to thermosiphon effect) from the lower part of the injection valve up to the upper part of the valve, wherein the reservoir volume is located in the upper part. The reservoir volume suitably encloses the first line like a jacket.

It is also possible to cool the reservoir volume externally, for which purpose it is possible to use the coolant of the internal combustion engine, for example. The reservoir volume is advantageously arranged peripherally inside the injection valve with its outer wall close to an outer circumference of the body. The reservoir volume is therefore also able to dissipate heat energy outwards, which affords improved cooling of the fuel and thereby assists the cooling effect of the cooling device.

In one example, the injection valve comprises at least one cooling element, which has a thermally conductive connection to the thermosiphon cooling device, which is the reservoir volume. This again improves the cooling of the fuel and likewise assists the cooling effect of the cooling device. In another example, the cooling element may comprise fins, which are arranged externally around the injection valve (around the circumference of its body). The fins increase the effective surface of the injection valve, so that the cooling effect for cooling the warm fuel in the reservoir volume is further improved.

In yet another example, the upper area of the injection valve may be actively cooled by coolant. For this purpose, fuel from the fuel tank may be supplied as coolant. In particular, it will be possible to bring coolant from the internal combustion engine, so that the upper area, possibly together with the reservoir volume, and/or also the fins, and/or the outer area of the injection valve are cooled by the coolant.

Although the development according to the disclosure serves to cool the fuel in the inoperative injection valve to an extent, the development according to the disclosure represents a cost-effective means of cooling the fuel retained in the injection valve, the cooling being sufficient to prevent critical values of the retained fuel. The device may obviously also be working when the injection valve is operative. This is especially the case since the connection of the first line to the reservoir volume is maintained at also times, that is to say both in the inoperative state and in the operative state. Thus the injection valve with the arrangement according to the disclosure can also be cooled in the operative state. This has a positive effect on the fuel consumption and on the performance of the internal combustion engine.

The disclosure is particularly advantageous in dual-fuel vehicles, in which two different fuels are fed to the internal combustion engine, the internal combustion engine being operated for a while with the one fuel and then for a while with the other fuel. This may be, on the one hand, conventional gasoline or diesel fuel. On the other hand, this may be a gaseous fuel. The vehicle can thus be operated with the conventional fuel if the gas tank is empty and it is not possible to reach a refueling station. The range of the vehicle is thus extended compared to vehicles powered by gaseous fuels alone. The conventional fuel is conveniently injected directly into the combustion chamber, whilst the gaseous fuel is introduced into the intake tract. In this respect in a motor vehicle of flexible-fuel or also dual-fuel design or in a motor vehicle having an internal combustion engine which is operated both with port fuel injection and with direct fuel injection to the internal combustion engine, a flow of conventional fuel through the injection valve does not always ensue, in which case there is no flowing fuel to exert a cooling effect on the injection valve. Since the injection valve for the direct injection of the conventional fuel is inoperative due to operation of the internal combustion engine on the gaseous fuel (that is to say CNG, LNG, methanol, ethanol, natural gas, for example), there is therefore no fuel flow passing through it. With the disclosure, however, the inoperative injection valve, that is to say the fuel retained therein, is sufficiently cooled.

It may be pointed out that the features and measures individually cited in the following description may be combined with one another in any technically appropriate manner and may set forth further developments of the system. The description additionally characterizes and specifies the disclosure particularly in conjunction with the figures.

DETAILED DESCRIPTION

Figure 1:
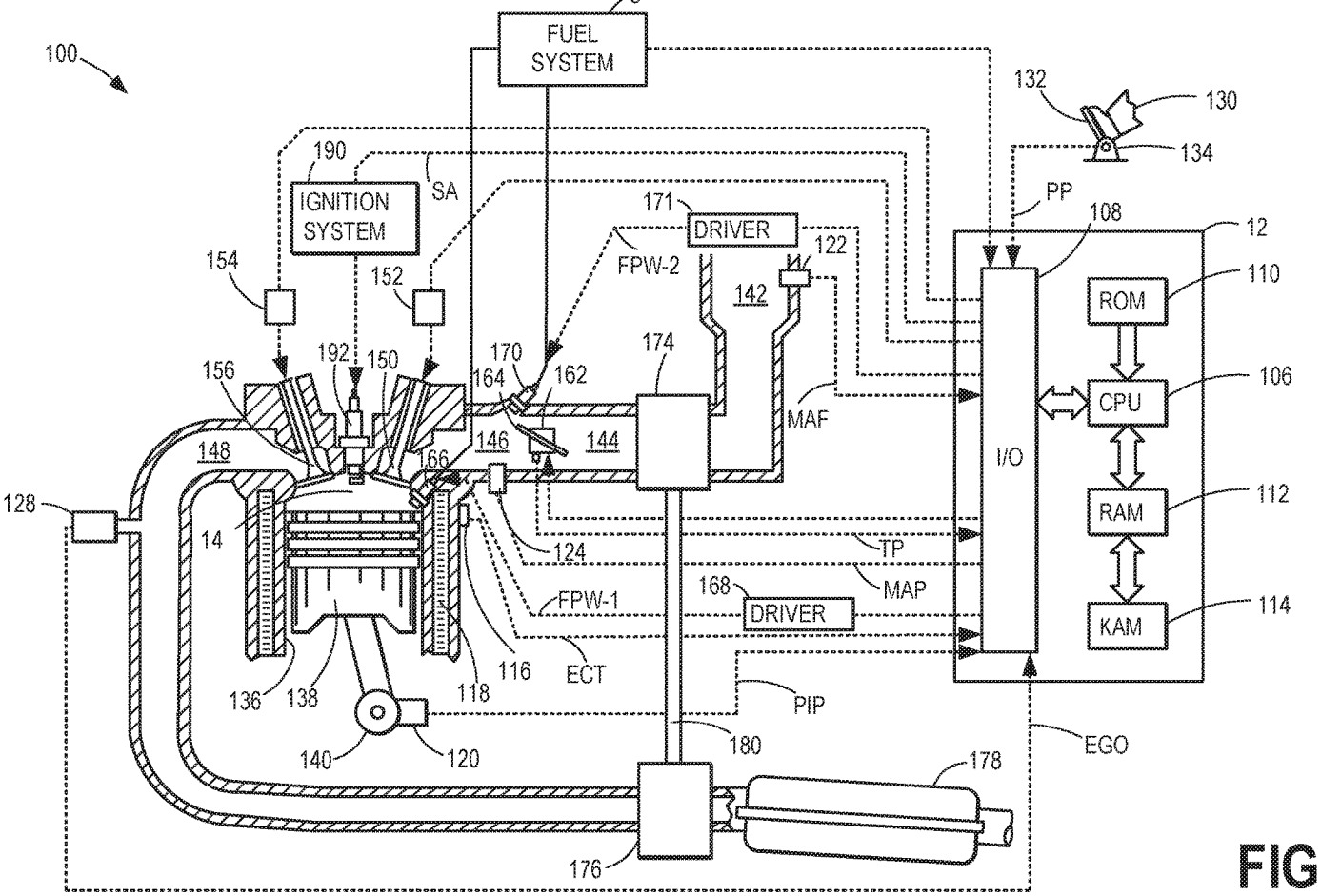
FIG. 1 schematically depicts an example embodiment of a cylinder of an internal combustion engine.

FIG. 1 depicts an example of a combustion chamber or cylinder of internal combustion engine 100. Engine 100 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 100 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 100.

Cylinder 14 can receive intake air via a series of intake air passages 142, 144, and 146. Intake air passage 146 can communicate with other cylinders of engine 100 in addition to cylinder 14. In some examples, one or more of the intake passages may include a boosting device such as a turbocharger or a supercharger. For example, FIG. 1 shows engine 100 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 100 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 100 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 100 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 100, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 100 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 100 may initiate combustion by auto-ignition or by injection of fuel as may be the case with some diesel engines.

In some examples, each cylinder of engine 100 may be configured with one or more fuel injectors for providing fuel thereto. As a non-limiting example, cylinder 14 is shown including two fuel injectors (also known as injection valve or injection nozzle) 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (DI) of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (PFI) into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved. Details of different components of a fuel injector (injectors 170 and 166) is discussed in relation to FIGS. 2 and 3.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 100, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. The controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 100 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Figure 2:
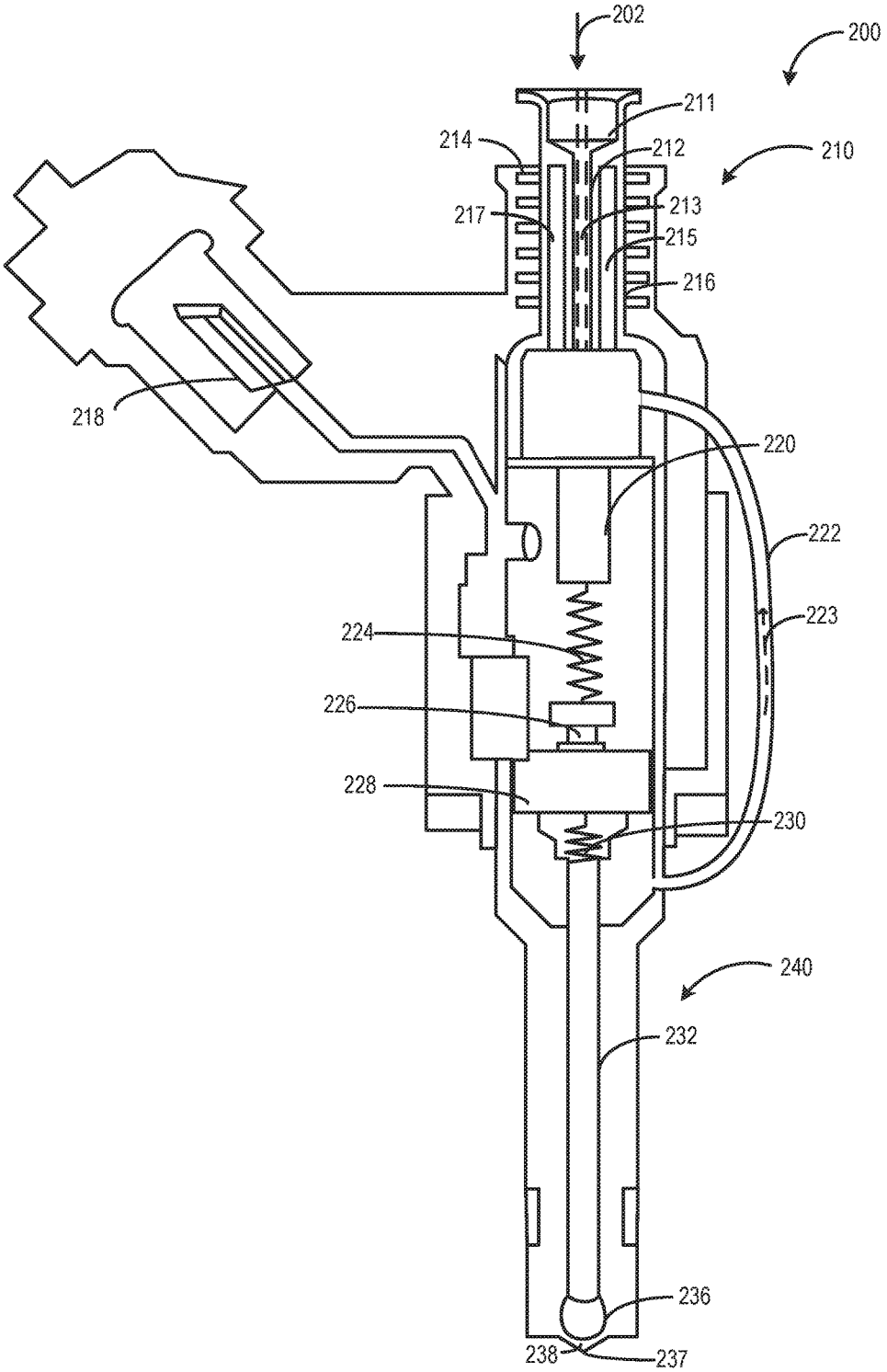
FIG. 2 shows a cross-sectional view of an example embodiment of an injection valve that may be used with the engine of FIG. 1.

FIG. 2 shows a cross-sectional view of an example embodiment of an injection valve 200 as used in an internal combustion engine. Such injection valves may be used for both direct injection and port injection. In one example, the injection valve 200 is the fuel injector 166 as seen FIG. 1. In another example, the injection valve 200 is the fuel injector 170 as seen in FIG. 1. The injection valve may comprise an upper portion 210 and a lower portion 240. During operation, the fuel to be injected via the injection valve may enter the upper portion 210 of the valve from the top as shown by the solid arrow 202. A passage 213 may form a fuel line (also called the first line) for the fuel to pass through the upper portion 210 of the injection valve 200. During operation of the injection valve 200, the flow of fuel through the fuel line 213 may suffice to cool the injection valve 200 without the requirement of any additional cooling mechanism. A sealing device 211 may be positioned at the top end of the injection valve 200. Enclosing the fuel passage 213, a filter 212 may be provided for removing any impurities that may be present in the fuel.

On both sides of the fuel passage 213, two reservoir volumes 215 and 217 may be provided. The fuel enclosed in the respective reservoir volumes 215 and 217 may be utilized for cooling the injection valve especially during periods of inactivation. During such periods of inactivation of the valve, the temperature of the valve may increase causing potential damage to the injection valve components (e.g., the tip 237). In addition, fuel trapped in the valve on being exposed to the high temperature may expand and cause further damage to the valve components. The fuel circulating through the reservoir volumes 215 and 217 may provide a cooling effect on the valve owing to thermosiphon effect. Due to the thermosiphon effect, the hot fuel may rise to the top of the respective reservoir volume and after dissipation of heat to the surrounding may again drop through the same volume due to gravity. Any additional component (pump) is not required for attaining the cooling effect using this technique. In order to increase the surface area of the top portion 200 of the injection valve 200, a plurality of fins 214 may be included on both sides walls of the injection valve 200. The increased surface area provides an increased opportunity for heat dissipation from the circulating fuel.

In order to facilitate circulation of fuel from the lower part of the injection valve up to the upper part of the valve, an additional fuel line 222, may be included. The line 222 may be within the injector housing, or outside of the housing as illustrated. A dotted arrow 123 shows the direction of fuel flow through the fuel line 222 due to thermosiphon effect. The fuel line 222 may be fluidically coupled to the reservoir volumes 215 and 217. The fuel line may be in parallel with other passages in the injector between the inlet and outlet. The line 222 may be coupled at both ends below the fins 214 (in a direction toward the injector injection tip). Also the width of reservoir volumes 215 and 217 may be increased to achieve increased cooling effects (due to increased surface area for fuel circulation and heat dissipation). As an example, the width of volumes 215 and 217 may each be wider than any fluid passages below (i.e., toward the injector tip) these volumes so as to enable the thermosiphon effect to provide sufficient cooling, without unnecessarily increasing the volume within the injector more than is needed. The details relating to the cooling function of the reservoir volumes 215 and 217 via thermosiphon effect is discussed in relation to FIG. 3.

The injection valve 200 may further comprise components including an adjustment sleeve 220, a pair of springs 224 and 230, an armature 228 and a stop ring 226. The lower portion 240 of the valve may comprise a valve needle 232 and a valve ball 236. During fuel injection, the valve ball 236 may first move upwards (due to movement of the valve needle 232) to facilitate accumulation of fuel in a fuel sack 238 and then the valve ball 236 may push down on the fuel sack 238 in order to inject the fuel via the tip 237 of the valve, wherein the tip may comprise an aperture. In order to communicate with the engine controller, the injection valve 200 may further comprise contact pins 218 for making electrical contacts with a contact plug (not shown).

Figure 3:
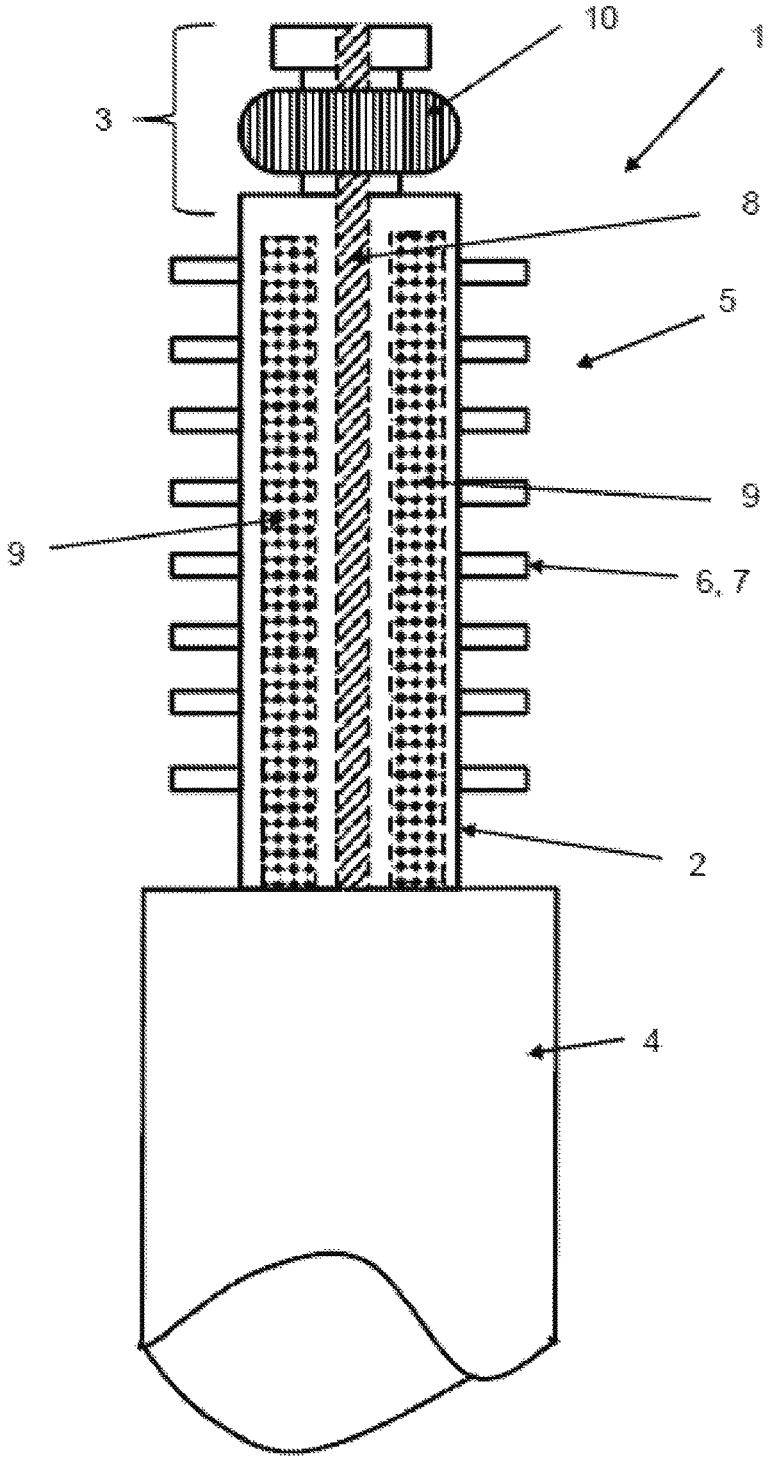
FIG. 3 shows a detailed diagrammatic representation of a part of the injection valve of FIG. 1.

FIG. 3 shows an injection valve 1 for an internal combustion engine of a motor vehicle, such as an automobile. In one example, the injection valve 1 may be the injection valve 200 as seen in FIG. 2. In another example, the injection valve 1 may be the fuel injector 166 as seen in FIG. 1. In yet another example, the injection valve 200 may be the fuel injector 170 as seen in FIG. 1.

The injection valve 1 comprises a body 2, which extends from an upper area 3 to a lower area (tip) 4 of the injection valve 1. The lower area (tip) 4 of the injection valve 1 may be the lower portion 140 as described in FIG. 1. Components of the lower area 4 as previously discussed in FIG. 2 are not reintroduced in FIG. 2. The injection valve 1 comprises a cooling device, which is a thermosiphon cooling device 5.

Arranged externally on the body 2 is a cooling element 6. In this example embodiment, the cooling element 6 is designed as cooling fins 7. On the inside the body comprises a first, that is to say inner line 8 and a reservoir volume 9 (such as the reservoir volumes 215 and 217 in FIG. 2) enclosing the inner line 8. Fuel is led or delivered through the inner line 8 to the tip of the injection valve 1. If the injection valve 1 is operative, this is sufficiently cooled by the flow of fuel via the inner line 8 flowing towards the tip 4. The reservoir volume 9 encloses the first line 8 (inner line) like a jacket.

The reservoir volume 9 can be seen arranged very close to an outer circumference of the body 2. It is also possible for the reservoir volume 9 with its outer wall to form at least portions of the outer circumference of the body 2. The reservoir volume 9 would thus have direct contact with the surroundings via its outer wall.

If the injection valve is non-operative, there is no fuel flow through the inner line 8. Under such circumstances when the internal combustion engine is still in operation, by use of another fuel, the inactive injection valve is required to be cooled.

If the injection valve 1 is inactive, that is to say inoperative, the fuel retained in the reservoir volume 9 is warmed by the effect of heat from operation of the of the internal combustion engine, and rises from the tip 4 of the injection valve 1 towards the upper area 3 (head area). The fuel retained inside the reservoir volume cools and sinks again towards the tip 4. The warmed fuel present in the reservoir volume 9 dissipates some of its absorbed heat outwards to the body 2, thereby producing a certain cooling effect, the cooled fuel being led towards the tip of the injection valve 1. Thus a coolant circuit is formed without any impulsion (without a pump). Here the coolant is fuel of conventional type, that is to say diesel fuel or gasoline.

The reservoir volume 9 may be adjustable in terms of its volume, also in its external surface, so that a suitable cooling effect of the fuel present in the reservoir volume 9 can be achieved. An additional fuel line (such as the fuel line 222 in FIG. 2) may be included to enhance the flow of fuel from the lower part of the injection valve up to the upper part of the valve due to thermosiphon effect. The fuel line (not shown in FIG. 3) may be fluidically connected to the reservoir volumes 9. The reservoir volume 9 is an integral part of the thermosiphon cooling device 5. The cooling elements 6 embodied as cooling fins 7 are arranged on a circumferential surface of the body 2, which increases the effective surface. Thus the cooling effect is further improved.

Also, the outer surface of the body 2 may be cooled, possibly even also externally by coolant from the operating internal combustion engine. The cooling effect can therefore be further improved. The reservoir volume 9 may obviously also be cooled externally, that is to say likewise by means of the coolant of the internal combustion engine, for example, in order to improve the cooling effect further. Also visible in FIG. 3 is a sealing device 10, which is arranged on the upper area 3 and through which the first line 8 extends. The first line 8 is connected to a fuel supply, which delivers fuel to the injection valve 1, when this is operative.

In one example, an injection valve for an internal combustion engine of a motor vehicle comprises a cooling device for cooling the injection valve, wherein the cooling device is a thermosiphon cooling device comprising a reservoir volume, and a cooling element of the cooling device having a thermally conductive connection to the reservoir volume. In the preceding example, additionally or optionally, the thermosiphon cooling device comprise a first line and the reservoir volume. In any or all of the preceding examples, additionally or optionally, the first line and the reservoir volume are arranged concentrically with one another. In any or all of the preceding examples, additionally or optionally, the reservoir volume has a medium-carrying connection to a first line. In any or all of the preceding examples, additionally or optionally, the cooling element is designed as a fin arranged on a body of the injection valve. In any or all of the preceding examples, additionally or optionally, the reservoir volume is arranged inside the injection valve close to an outer circumference of the body of the injection valve. Any or all of the preceding examples further comprising, additionally or optionally, a fuel line connecting a lower portion of the injection valve to an upper portion of the injection valve, wherein the fuel line enhances flow of fuel from the lower portion of the injection valve to the upper portion of the injection valve due to thermosiphon effect. In any or all of the preceding examples, additionally or optionally, the fuel line is fluidically coupled to the reservoir volume. In any or all of the preceding examples, additionally or optionally, the fuel line is parallel to the reservoir volume.

In another example, a method for cooling an injection valve of an engine, comprises: during cylinder deactivation, flowing fuel via an additional fuel line in parallel with a reservoir volume from a lower portion to an upper portion of an injection valve; dissipating heat from the fuel via cooling elements on a body of the injection valve positioned above the additional line, cooling the injection valve; and circulating the fuel through the reservoir volume via a thermosiphon effect. In the preceding example, additionally or optionally, the cooling elements include fins with a surface area on the body of the injection valve. In any or all of the preceding examples, additionally or optionally, the injector is coupled directly in the deactivated cylinder. In any or all of the preceding examples, additionally or optionally, the thermosiphon effect includes rising of hot fuel from the lower portion to the upper of the injection valve, dissipation of heat from the hot fuel to surrounding material and falling of cooled fuel from the upper portion to the lower portion of the injection valve due to gravitation.

In yet another example, an injection valve system comprises an upper portion of the injection valve; a lower portion of the injection valve; a fuel line connecting the upper and lower portions of the injection valve in parallel with reservoir volumes within the upper portion of the injection valve; a first line within the upper portion of the injection valve; fins on an outer wall of the upper portion of the injection valve; wherein the reservoir volumes enclosing the first line cool the injection valve via a thermosiphon effect. In the preceding example, additionally or optionally, the thermosiphon effect includes rising of hot fuel through the reservoir volumes, dissipation of heat through the fins and then falling of fuel through the reservoir volume under the influence of gravity. In any or all of the preceding examples, additionally or optionally, the injection valve is coupled directly in a cylinder, the cylinder coupled in an engine having a port injector coupled to inject fuel to a port of the cylinder. In any or all of the preceding examples, additionally or optionally, the injection valve is coupled directly in a cylinder, the cylinder coupled in an engine having a direct injector coupled to inject fuel directly into the cylinder. In any or all of the preceding examples, additionally or optionally, at least one of the port injector and the direct injector can be selectively deactivated.

In this way, by including reservoir volumes in the upper part of an injection valve, the valve may be effectively cooled by thermosiphon effect. The increased surface area of the valve may facilitate dissipation of heat from the warm fuel that rises through the reservoir volumes due to thermosiphon effect. The technical effect of utilizing thermosiphon effect to cool the injection valve especially during periods of inactivity is that by utilizing this physical phenomenon, no extra components (e.g., a pump) or external coolant is required to cool the injection valve, thereby causing component and cost reduction.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for cooling an injection valve of an engine, comprising:

during cylinder deactivation, flowing fuel via an additional fuel line in parallel with a reservoir volume from a lower portion to an upper portion of the injection valve coupled directly in a deactivated cylinder, the injection valve including an inlet line disposed in the upper portion, and the reservoir volume enclosing the inlet line;

dissipating heat from the fuel via cooling fins on a body of the injection valve, thereby cooling the injection valve; and circulating the fuel through the reservoir volume via a thermosiphon effect, wherein the injection valve includes a valve needle with a valve ball at one end and a spring at another, opposite end, and wherein the additional fuel line couples the lower portion of the injection valve proximal to the another, opposite end of the valve needle to the upper portion of the injection valve below the cooling fins.

2. The method of claim 1, wherein the cooling fins include a surface area on the body of the injection valve.

3. The method of claim 1, wherein the additional fuel line is housed outside of an injector housing.

4. A method for cooling an injection valve of an engine, comprising:

during cylinder deactivation, flowing fuel via an additional fuel line in parallel with a reservoir volume from a lower portion to an upper portion of the injection valve, the injection valve including an inlet line disposed in the upper portion, and the reservoir volume enclosing the inlet line;

dissipating heat from the fuel via cooling fins on side walls of the upper portion of the injection valve positioned above the additional fuel line, thereby cooling the injection valve; and circulating the fuel through the reservoir volume via a thermosiphon effect, wherein the thermosiphon effect includes rising of hot fuel from the lower portion to the upper portion of the injection valve, dissipation of heat from the hot fuel to surrounding material and falling of cooled fuel from the upper portion to the lower portion of the injection valve due to gravitation, wherein the injection valve includes a valve needle with a first end proximal to an injector tip and a second end proximal to a spring, the first end opposite to the second end, and wherein the additional fuel line couples the lower portion of the injection valve proximal to the second end of the valve needle to the upper portion of the injection valve below the cooling fins.

5. The method of claim 4, wherein the injection valve is coupled directly in a deactivated cylinder.

* * * * *